US008118185B2

(12) United States Patent
Smith et al.

(10) Patent No.: US 8,118,185 B2
(45) Date of Patent: Feb. 21, 2012

(54) CONTAINER CLOSURES INCLUDING A RETAINING FLANGE AND A CUTTER

(75) Inventors: Matthew Eric Smith, Isle of Man (GB); Karl Mondszein, Mansfield (GB)

(73) Assignee: Carbonite Corporation, Panama City (PA)

( * ) Notice: Subject to any disclaimer, the term of this patent is extended or adjusted under 35 U.S.C. 154(b) by 503 days.

(21) Appl. No.: 12/301,433

(22) PCT Filed: May 15, 2007

(86) PCT No.: PCT/GB2007/001781

§ 371 (c)(1), (2), (4) Date: Dec. 17, 2008

(87) PCT Pub. No.: WO2007/138249

PCT Pub. Date: Dec. 6, 2007

(65) Prior Publication Data

US 2009/0184084 A1 Jul. 23, 2009

(30) Foreign Application Priority Data

May 26, 2006 (GB) ..... 0610554.8

(51) Int. Cl.
*B65D 17/30* (2006.01)
*B65D 51/24* (2006.01)
*B67B 7/44* (2006.01)

(52) U.S. Cl. ..... 220/267; 220/212; 220/260; 220/277; 215/228; 215/302; 81/3.15

(58) Field of Classification Search ..... 215/237, 215/295, 302–305, 257, 228; 220/262, 267–270, 220/212, 260, 277; 81/3.25, 3.41, 3.29, 3.47, 81/3.15; 7/152
See application file for complete search history.

(56) References Cited

U.S. PATENT DOCUMENTS 2,781,149 A * 2/1957 Fried ..... 220/267
2,937,778 A * 5/1960 Wall, Jr. ..... 215/304

FOREIGN PATENT DOCUMENTS

EP 0200392 A2 11/1986
WO 0236452 A 5/2002
WO 2004/043800 A2 5/2004
WO 2005/092732 A1 10/2006

* cited by examiner

*Primary Examiner* — Robin Hylton
(74) *Attorney, Agent, or Firm* — Harry K. Ahn; Abelman Frayne & Schwab

(57) ABSTRACT

A closure for a container comprises a circular closure plate (2, 4), integral with the outer edge of which is a depending skirt (8), integrally connected to the lower end of which by means of a resilient annular integral hinge (10) is an annular flange (12), which extends generally upwardly and inwardly. The closure also includes a cutter assembly which includes a cutting blade (38) and is mounted to rotate about the center of the closure plate (2, 4). The integral hinge (10) has a hole formed in it through which the cutting blade (38) extends. Rotation of the cutter assembly about the center of the closure plate thus results in cutting of the integral hinge (10) and thus in release of the closure plate (2, 4) and the depending skirt (8) from the annular flange (12).

8 Claims, 3 Drawing Sheets

CONTAINER CLOSURES INCLUDING A RETAINING FLANGE AND A CUTTER

CROSS REFERENCE TO RELATED APPLICATIONS

This application claims priority to PCT application No. PCT/GB2007/001781, filed May 15, 2007, which claims priority to GB patent application No. 0610554.8, filed May 26, 2006, both of which are incorporated herein by reference.

The present invention relates to closures for containers, particularly for beverage containers, and is concerned with that type of closure which comprises a substantially circular closure plate, integral with the outer edge of which is a depending skirt, integrally connected to the lower end of which by means of a resilient annular integral hinge is an annular flange, which extends generally upwardly and inwardly.

Such a container closure is disclosed in WO 2005/092732. The closure is applied to a container for beverages or other free flowing or viscous liquids or foodstuffs of the type including a neck, extending around which is a downwardly directed shoulder. In use, the closure is moved downwardly over the neck and the flange contacts the upper surface of the neck and is rotated outwardly by it about the integral hinge. When the underside of the closure plate engages the upper surface of the neck, a force is exerted on the closure so that the closure plate is deformed slightly at its contact with the neck by virtue of its resilience. The resulting small further downward movement of the closure is sufficient to permit the free end of the flange to move past the shoulder. The resilience of the integral hinge causes the flange to rotate inwardly until its free end surface is beneath the shoulder, whereby the closure is now captive on the container and the downward force is then removed. The closure now forms a seal with the neck of the container at one or more of a number of positions, namely the engagement of the free end of the flange with the underside of the shoulder, the engagement of the inner side surface of the free end of the flange with the side surface of the neck under the resilient force exerted by the resilient hinge, the engagement of the underside of the cover plate with upper surface of the neck by virtue of the tension in the depending skirt and the engagement of the inner surface of the upper portion of the neck with the underside of a concave portion of the cover plate, which extends a small distance into the neck.

The closure disclosed in WO 2005/092732 includes a rupture tab, which extends downwardly and outwardly from the depending end and is integrally connected to it by two spaced parallel lines of weakness. When it is desired to open the container, the lower end of the rupture tab is pulled outwardly and the lines of weakness rupture. The upper edge of the tab, which is integral with the closure plate, rotates and the seals are broken. The integral hinge is locally ruptured and the continued application of force to the rupture tab results in progressive tearing of the integral hinge and the closure plate and depending skirt are released from the container.

Whilst effective, the rip tab does require the application of a reasonable amount of force and this is not always practicable. It is, therefore, the object of the invention to provide a closure of the type referred to above with means for releasing it from a container which are cheap, simple and reliable and may be operated with only a minimal application of force.

According to the present invention, a closure of the type referred to above includes a cutter assembly, which includes a cutting blade and is mounted to rotate about the centre of the closure plate, the integral hinge having a hole formed in it through which the cutting blade extends, whereby rotation of the cutter assembly about the centre of the closure plate results in cutting of the integral hinge by the cutting blade and thus in release of the closure plate and depending skirt from the annular flange.

The closure in accordance with the invention thus includes a captive cutter assembly which is mounted to rotate about the centre of the closure plate. The cutter assembly includes a cutting blade which extends through a hole formed in the integral hinge.

If the cutter assembly is rotated manually, the cutting blade contacts the integral hinge defining one end of the hole and the hinge is thus cut by the blade. Continued rotation of the cutter results in progressive cutting of the hinge until the closure plate is released from the flange and thus from the container. The cutter assembly may be retained captive in a number of different ways and one possibility would be to provide it and the closure plate and/or the depending skirt with cooperating projections and grooves or keyways which retain the cutter assembly in position and guide it for rotation about the centre of the closure plate.

If the cutter assembly includes only a single cutting blade, it is of course necessary that the cutter assembly be rotated in the correct direction, that is to say the direction in which the cutting blade comes into contact with the integral hinge. It is, however, preferred that the cutting assembly is operative regardless of the direction which it is rotated and it is therefore preferred that the cutter assembly includes two oppositely directed cutting blades.

It is preferred that each cutting blade comprises two cutting edges which are opposed to one another and are inclined at an acute angle to one another and thus define a generally V-shaped notch, the apex of which is substantially aligned with the integral hinge. This not only improves the cutting action of the blade but also serves to maintain the blade accurately in alignment with the integral hinge.

As mentioned above, the cutting assembly may be held captive and mounted for rotation in a variety of different manners but in the preferred embodiment an upstanding pivot pin is integrally formed at the centre of the closure plate and is rotatably received in a hole in a radial arm which forms part of the cutter assembly. This radial arm will extend from the centre of the circular closure plate to its edge and will then be connected to a depending portion which extends down the side of the depending skirt and connected to which is the cutting blade which will then extend upwardly, that is to say back towards the closure plate, through the hole in the integral hinge into the space defined between the inner surface of the depending skirt and the outer surface of the flange. There is a risk that if the radial arm were mounted solely on the central pivot pin it could inadvertently become skewed and thus jammed and it is therefore preferred that one of the radial arm and the depending skirt affords a guide projection which is slightly received in a complimentary guide recess formed in the other of the radial arm and the depending skirt. The cooperation of the guide projection and the guide recess guides the movement of the radial arm during rotation and ensures that it remains in the desired rotational plane and retains the cutting blade in alignment with the integral hinge.

It is sufficient if the closure includes a single cutter assembly and this will of course necessitate the cutter assembly being rotated through 360° for the closure plate to be fully released from the container. However, the forces are more balanced and rotation through a smaller angle is necessary if there are two or more cutter assemblies and these are preferably equiangularly spaced about the centre of the closure plate and are connected to be rotated in synchronism. If, as in the preferred embodiment, there are two cutter assemblies comprising radial arms rotationally mounted on a central pivot pin upstanding from the closure plate, there is a variety of ways in which they can be rotationally coupled but in the preferred embodiment one of the radial arms has at least one projection or stud formed on it which is received in a complimentary hole in the other radial arm. This will ensure that their relative angular spacing, which is preferably 180°, is maintained constant.

The greatest force must be applied to the cutter assembly at the point at which it initiates cutting of the integral hinge. Once the cutting has commenced, it is found that a significantly lower force is required to maintain the cutting procedure. If there are two diametrically opposed cutting blades and these both contact the edges of the holes in the integral hinge in which they are received at the same instant, a significant force may be required to initiate cutting. In the preferred embodiment, the length of the two holes in the integral hinge in the circumferential direction is different, whereby one of the cutting blades will engage the edge of the hole and thus initiate cutting of the integral hinge before the other. This will mean that the additional force required to initiate cutting at the two cutter blades will have to be exerted separately, that is to say one after the other, rather than simultaneously, whereby the maximum force that will have to be exerted on the cutter assemblies to rotate them is reduced.

The closure plate, depending skirt, integral hinge and flange are preferably a one piece injection moulded component, preferably of polypropylene. The or each cutter assembly is preferably also an injection moulded plastic component and they may in practice be moulded integrally with the remainder of the closure and connected to it by short rupturable webs, which may be ruptured after moulding, whereafter the cutter assemblies are mounted on the remainder of the closure. It is not necessary for the cutting blades to be metallic or indeed particularly sharp and it is found that the point load produced by the engagement of a thin polypropylene web, constituting the cutting blade, against a thin polypropylene web extending at right angles to it, namely the integral hinge, is sufficient to initiate cutting of the integral hinge.

Further features and details of the invention will be apparent from the following description of one embodiment of closure cap which is given by way of example with reference to the accompanying drawings, in which.

Figure 1:
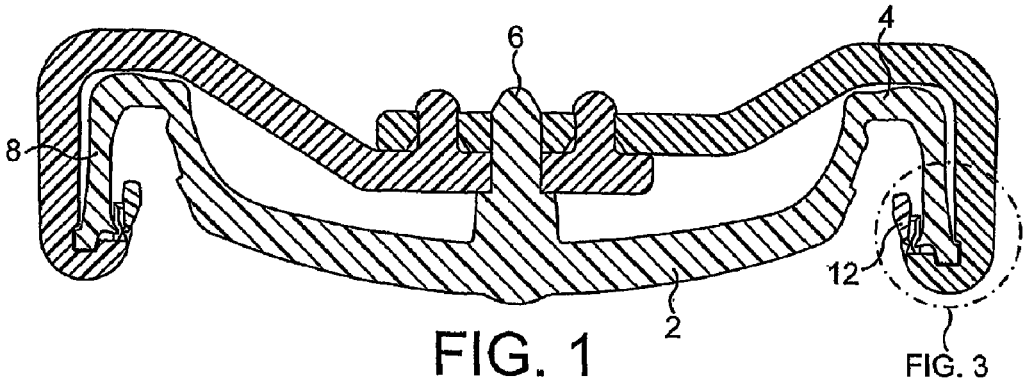
FIG. 1 is an axial sectional view of the closure cap.
Figure 2:
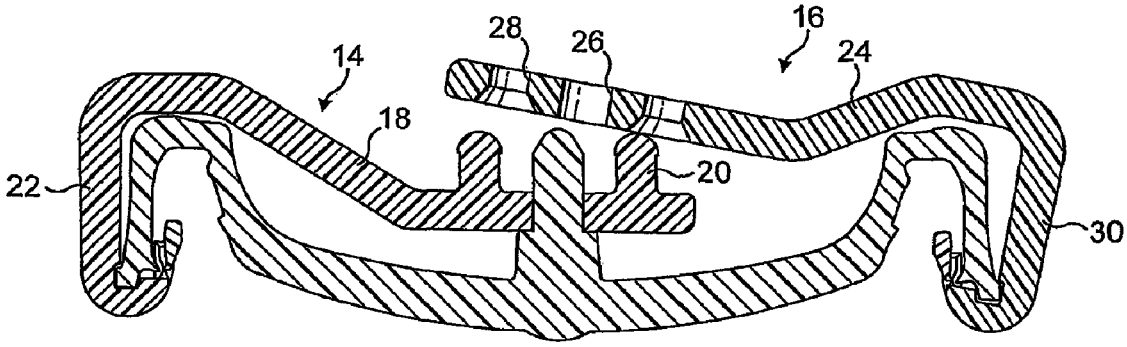
FIG. 2 is a view similar to FIG. 1 showing the cap in the course of assembly.

Referring firstly to FIGS. 1 and 2, the closure comprises a circular closure plate comprising a concave portion 2, the outer edge of which is integral with a generally horizontally extending web 4. Upstanding from the centre of the concave portion is a boss or pivot pin 6, the function of which will be described below. Integral with the outer edge of the web 4 is a depending skirt 8. Integrally connected to the inner surface of the skirt 8 at or close to its lower end by means of a thin, resilient annular integral hinge 10 is a flange 12, which extends generally upwardly and slightly inwardly. Formed in the integral hinge 10 are two diametrically opposed holes of slightly different length, in the circumferential direction, the purpose of which will be described below.

The closure also includes two elongate cutter arms 14,16, each of which has a radially extending portion, connected to the outer end of which is a cutter mechanism. The cutter arm 14 includes a radial portion 18, at the inner end of which is a hole 19 in which the pivot pin 6 is rotatably received. On each side of the hole is an upstanding stud 20. Integral with the outer end of the radial portion is a downwardly extending portion 22. The other cutter arm 16 is generally similar and at the end of its radial portion 24 there is a hole 26 in which the pivot pin 6 is rotatably received. On each side of the hole 26 is a further hole 28, which receives a respective one of the studs 20. Integral with the outer end of the radial portion 24 is a downwardly extending portion 30. Connected to the two downwardly extending portions 22,30 are respective cutter mechanisms, but since these are identical only that connected to the portion 30 will be described. Integral with the downwardly extending portion 30 is one limb of a U-shaped portion 32. Integral with the other limb of the U-shaped portion 30 is an upstanding cutter portion 34, in each of whose side surfaces is a V-shaped notch 36 defined by two inclined blades 38. The cutter portion 34 extends through a respective one of the two holes in the integral hinge 10 and the apexes of the V-shaped notches are in alignment with respective edges of the integral hinge defining the hole in it.

Integrally formed at the lower end of the depending skirt 8 is a guide formation 40, which extends both downwardly and laterally outwardly beyond the skirt 8. The formation 40 is slidingly received in a correspondingly shaped recess 42 in the U-shaped portion 32 of the cutter arms.

Figure 3:
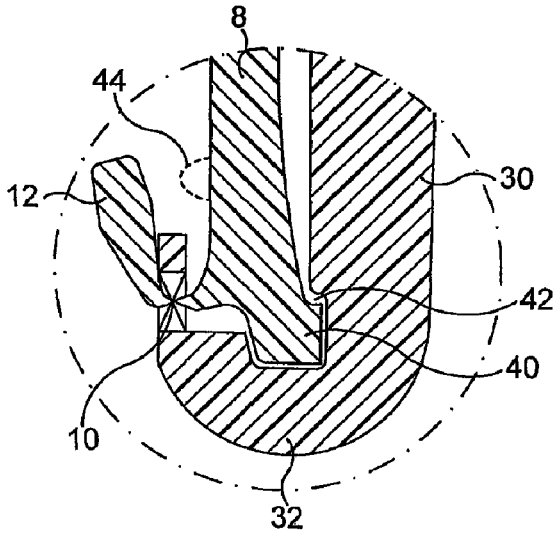
FIG. 3 is a view on an enlarged scale of the circular area in FIG. 1.
Figure 4:
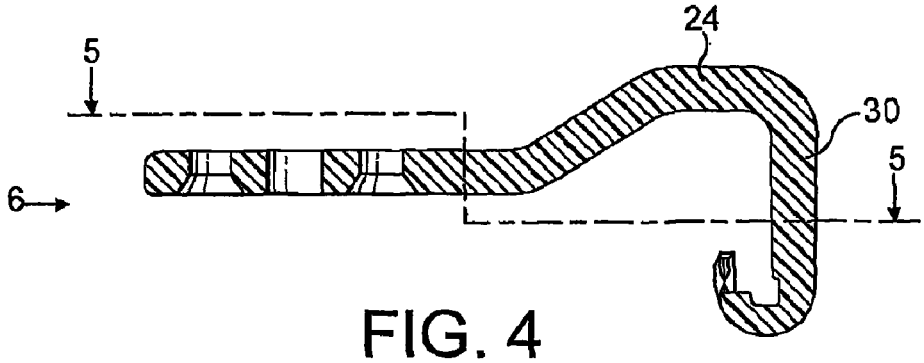
FIG. 4 is a side view of one of the cutter arms.
Figure 5:
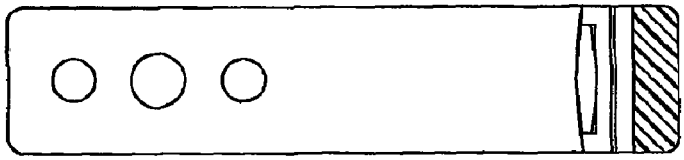
FIG. 5 is a sectioned plan view of the cutter arm of FIG. 4 on the line IV-IV.
Figure 6:
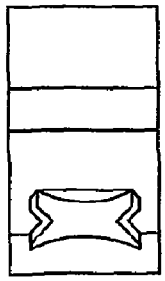
FIG. 6 is an end view of the cutter arm of FIG. 4 seen in the direction of the arrow VI.
Figure 7:
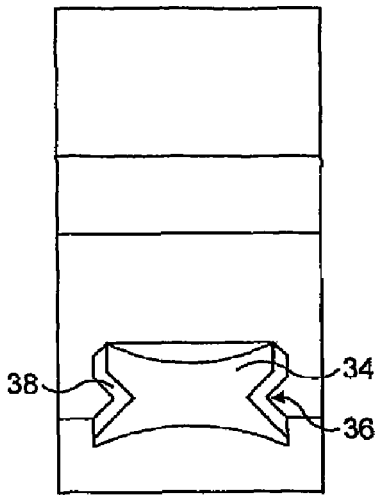
FIG. 7 is the same as FIG. 6, but on an enlarged scale.
Figure 8:
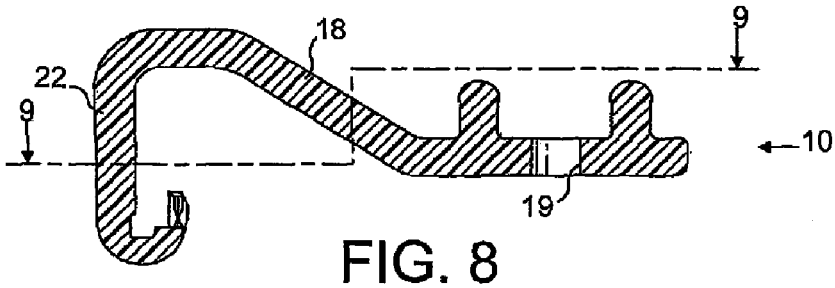
FIGS. 8, 9 and 10 are views corresponding to those of FIGS. 4, 5 and 6, respectively, of the other cutter arm.
Figure 9:
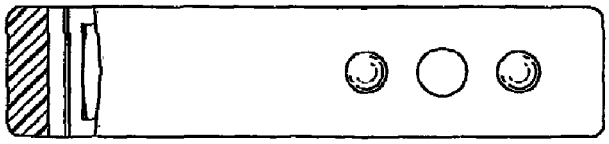
Figure 10:
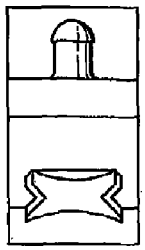

In use, the closure is applied to a container in the manner described above. A seal is formed between the underside of the web 4 and the upper surface of the neck of the bottle. If an alternative or additional seal is required, an annular protuberance may be formed on the inner surface of the lower end of the skirt 8 and/or on the outer surface of the flange 12, as indicated diagrammatically by the protuberance 44 shown in dotted lines in FIG. 3. When the closure is applied to the container, the flange 12 is rotated to and retained in a position in which it is rotated outwardly with respect to that shown in FIG. 3. In this position the flange 12 is forced into engagement with the protuberance 44 and this forms a seal with it. Thus even if there should be no seal between the upper surface of the neck of the container and the underside of the web 4, the container is nevertheless sealed by virtue of the sealing engagement of the outer side surface of the flange 12 with the protuberance 44 and the sealing engagement of the free end of the flange 12 with the underside of the shoulder on the outer surface of the neck of the container.

If it is desired to open the container, the user grasps the two cutter arms and rotates them about the pivot pin 6. It is immaterial in which direction they are rotated because each cutter arm carries two oppositely directed cutter blades and one of them will engage the integral hinge regardless of the direction of rotation. Due to the fact that the two holes in the integral hinge are of different lengths in the circumferential direction, the cutter mechanism in the shorter of the holes will engage the integral hinge and begin to cut it before the other cutter mechanism. Once both cutter mechanisms have began to cut the integral hinge a light pressure on the cutter arms is sufficient to maintain the cutting process and once the cutter arms have been rotated through 180° the integral hinge is fully severed and the closure plate may be removed from the container together with the depending skirt and the cutter arms, leaving the flange 12 still in position around the neck of the bottle. Rotation of the cutter arms is of course about the pivot pin 6 and the engagement of the studs 20 in the holes 28 means that the two cutter arms rotate as a solid body. The engagement of the guide formation 40 in the recess 42 ensures that the rotation is smooth and that there is no risk of the cutter arms becoming skewed and thus jammed.

The closure plate, depending skirt, integral hinge and flange are a one-piece injection moulding of plastic material, preferably polypropylene. The two cutter arms may also be part of the integral moulding and connected to the remainder of the closure by the rupturable webs or bridges. After the moulding process, the webs or bridges are broken and the cutter mechanism of the arm 14 is placed into one of the holes in the integral hinge. The arm is then rotated clockwise until the pivot pin 6 is received in the hole 19. The cutter mechanism of the other arm 16 is then placed through the other hole in the integral hinge and the arm rotated anticlockwise. It passes through the position shown in FIG. 1 and the pivot pin 6 is then located in the hole 26 and simultaneously the studs 20 are located in the holes 28.

The invention claimed is:

1. A closure for a container comprising a substantially circular closure plate, integral with the outer edge of which is a depending skirt, integrally connected to the lower end of which by means of a resilient annular integral hinge is an annular flange which extends generally upwardly and inwardly, the closure further including a cutter assembly which includes a cutting blade and is mounted to rotate about the centre of the closure plate, the integral hinge having a hole formed in it through which the cutting blade extends, whereby rotation of the cutter assembly about the centre of the closure plate results in cutting of the integral hinge by the cutting blade and thus in release of the closure plate and depending skirt from the annular flange.

2. A closure as claimed in claim 1 in which the cutter assembly includes two oppositely directed cutting blades.

3. A closure as claimed in claim 1 in which each the cutting blade comprises two cutting edges opposed to one another and inclined at an acute angle to one another.

4. A closure as claimed in claim 1 in which an upstanding pivot pin is integrally formed at the centre of the closure plate and is rotatably received in a hole in a radial arm forming part of the cutter assembly.

5. A closure as claimed in claim 4 in which one of the radial arm and the depending skirt affords a guide projection which is slidably received in a complimentary guide recess formed in the other of the radial arm and the depending skirt, the cooperation of the guide projection and the guide recess guiding the movement of the radial arm during rotation and retaining the cutting blade in alignment with the integral hinge.

6. A closure as claimed in claim 1 in which there are two or more cutter assemblies which are equiangularly spaced about the centre of the closure plate and are connected to be rotated in synchronism.

7. A closure as claimed in claim 6 in which there are two cutter assemblies, each comprising a radial arm carrying a cutting blade received in a respective hole in the integral hinge, the length of one hole in the circumferential direction being greater than that of the other.

8. A closure as claimed in claim 2 in which each cutting blade comprises two cutting edges opposed to one another and inclined at an acute angle to one another.

* * * * *